United States Patent [19]

Levinthal

[11] Patent Number: 4,555,280

[45] Date of Patent: Nov. 26, 1985

[54] PROCESS FOR SIMULTANEOUSLY CRYSTALLIZING COMPONENTS OF EAK EXPLOSIVE

[75] Inventor: Michael L. Levinthal, Brigham City, Utah

[73] Assignee: Morton Thiokol, Inc., Chicago, Ill.

[21] Appl. No.: 648,430

[22] Filed: Sep. 10, 1984

[51] Int. Cl.[4] ..... D03D 23/00

[52] U.S. Cl. ..... 149/109.6; 149/46; 149/47; 149/61; 149/62; 149/92

[58] Field of Search ..... 149/92, 109.6, 46, 47, 149/61, 62

[56] References Cited

U.S. PATENT DOCUMENTS 4,419,155 12/1983 Wagaman et al. ..... 149/109.6
4,421,578 12/1983 Voreck ..... 149/92 X
4,481,048 11/1984 Cady et al. ..... 149/92 X

*Primary Examiner*—Stephen J. Lechert, Jr.
*Attorney, Agent, or Firm*—George F. Wheeler

[57] ABSTRACT

Improved process for manufacturing an explosive eutectic composition comprising about 46% by weight ammonium nitrate, about 46% by weight ethylene diamine dinatrate, and about 8% by weight potassium nitrate. First, potassium hydroxide, ammonia, water, nitric acid, and ethylene diamine are reacted in aqueous solution to produce the indicated components of the eutectic mixture. Then the solution is cooled to supersaturate each solute thereof and passed through a continuous crystallizer to crystallize the components of the product in eutectic proportions. The product is then separated from the mother liquor, which is recycled. The process can be operated continuously and safely without producing by-products or employing solvents which must be evaporated from the composition or disposed of.

12 Claims, 1 Drawing Figure

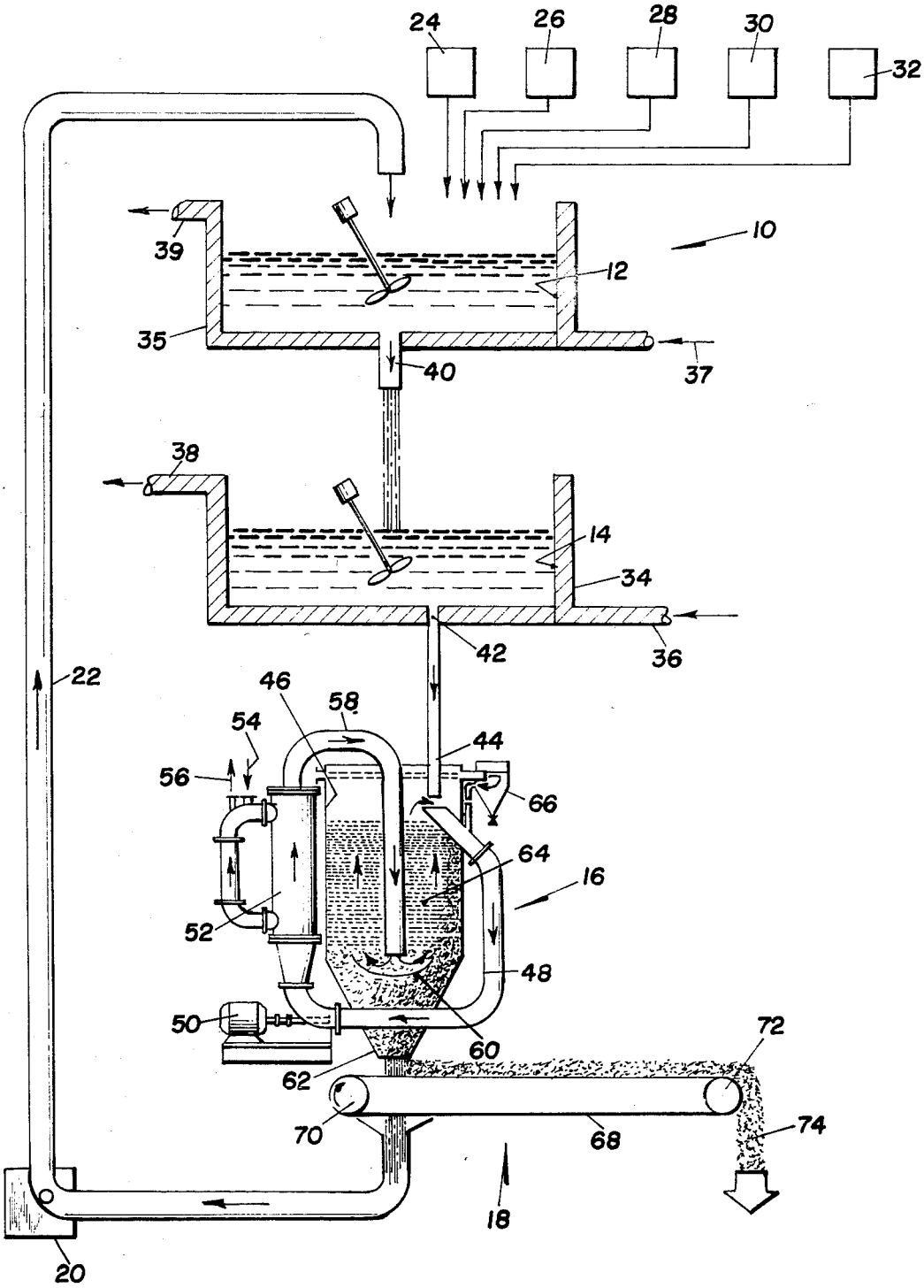
24
26
28
30
32
10
39
12
35
40
37
38
14
34
42
36
22
46
58
54
44
56
66
64
16
52
48
50
60
72
62
70
68
74
18
20

PROCESS FOR SIMULTANEOUSLY CRYSTALLIZING COMPONENTS OF EAK EXPLOSIVE

TECHNICAL FIELD

The invention is a process for forming a solid eutectic mixture of about 46% ammonium nitrate, about 8% potassium nitrate, and about 46% ethylene diamine dinitrate (all percentages and parts herein are by weight unless otherwise specified). This eutectic mixture, sometimes known in the art as "EAK", is a melt castable explosive used to fill explosive shells. (EAK denotes Ethylene diamine dinitrate, Ammonium nitrate, and Potassium nitrate, K, in the eutectic amounts.)

BACKGROUND ART

EAK is dangerous when stored in large quantities, particularly at elevated temperatures. For example, when EAK is heated to a typical casting temperature of about 100° C., a compact mass of more than about 500 pounds, or 37 gallons, of EAK exceeds its critical mass and will explode. For this reason, EAK can only be safely handled in small quantities, or at a temperature substantially below 100° C.

There are several known processes for manufacturing EAK. One such method is the alcohol process. In this process, nitric acid is added to a solution of ethylene diamine in ethanol or methanol; the product is ethylene diamine dinitrate. The latter material is filtered, washed, dried, melted, and combined with molten potassium nitrate and ammonium nitrate to produce EAK. One disadvantage of this process is that the solvents used in this process are flammable, so they do not substantially reduce the risk of handling ethylene diamine dinitrate (which is also a heat-sensitive explosive). The need to melt EAK is also a problem with this method. Furthermore, this is not a continuous process, due to the need to keep the amount of molten EAK below its critical mass as specified above. The primary advantage of this prior process is that ethylene diamine dinitrate can be removed from solution by filtering.

A second process which has been used to form EAK is the perchloroethylene process, in which ethylene diamine dinitrate is formed in perchloroethylene by the reaction between nitric acid and ethylene diamine. Ammonium nitrate and potassium nitrate are added to the mixture, its temperature is raised to melt EAK, and the mixture is then chilled with cold perchloroethylene to form granules of EAK. Three important disadvantages of the perchloroethylene method are that perchloroethylene participates somewhat in the reaction, perchloroethylene is occluded in the resulting granules, and the boiling point of perchloroethylene is sufficiently higher than 100° C. that any exotherm of EAK or its components will not be regulated by evaporation of the solvent to remove heat from the reaction mixture.

Another known process for forming EAK is the double-direct method. Here, ethylene diamine is added to a solution of ammonium nitrate and potassium nitrate in aqueous nitric acid (70%) at 60° C. The mixture is heated to 110° C. and a vacuum is applied to remove the water and nitric acid from the reaction mixture. Besides the previously described danger of maintaining a substantial quantity of EAK at 110° C., this process is not continuous, and requires a costly and time consuming vacuum stripping and solvent recovery process.

Still another EAK production process is the water process. This process, which has been proposed but apparently not tried, requires that liquid ammonia, then ethylene diamine, then potassium hydroxide be sequentially added to a 60% nitric acid solution. These added constituents form ammonium nitrate, ethylene diamine dinitrate, and potassium nitrate by reacting with nitric acid. The remaining water is then removed by a triple-effect evaporator and a wiped-film evaporator to produce dry EAK. It has been proposed to practice this as a continuous process. Again, however, the residual water must be removed by drying, which requires energy and time.

To summarize, prior processes mostly have been batch processes, have required that solvents be removed by evaporation, and have in some cases required heating of concentrated ethylene diamine dinitrate or EAK.

SUMMARY OF THE INVENTION

The object of the present invention is to remove the disadvantages noted above, and thereby provide an improved process for the manufacture of EAK, particularly a continuous process.

In this process, EAK is prepared by first forming an aqueous solution of ammonium nitrate, ethylene diamine dinitrate, and potassium nitrate, cooling the solution sufficiently to crystallize EAK in eutectic proportions directly from solution, and finally separating the crystallized EAK from the mother liquor.

The aqueous solution is preferably formed indirectly by combining water, nitric acid, potassium hydroxide, ethylene diamine, and ammonia. This indirect process eliminates the need to provide concentrated ethylene diamine dinitrate as a starting material.

In a preferred aspect of the invention, the process is operated continuously by recycling the mother liquor resulting from crystallization, then replenishing the mother liquor with the appropriate proportions of starting materials.

The invention has several advantages over the prior art. First, neither the reactant nor the reaction mixture are Class 1.1 (explosive) or Class 1.3 (self oxidizing propellant) materials. EAK is a Class 1.1 material, but is removed as rapidly as it is formed. Second, because all the reactants are consumed and the mother liquor is recirculated, substantially no expensive waste disposal procedure is necessary. Third, the product crystals are formed in a water medium and removed by filtration, so no solvent removal, containment, or recovery is necessary. Finally, the process can be performed continuously, rather than as a batch process. EAK is formed in a steady stream at a relatively low temperature, keeping the quantity and temperature of bulk EAK low enough to avoid the danger of an explosion. Because the three components of EAK are more soluble in water than in alcohol or other solvents by an order of magnitude or more, the subsequent crystallization process is more efficient in all respects.

BRIEF DESCRIPTION OF DRAWING

The drawing figure is a schematic representation of apparatus for practicing the invention. The parts of the apparatus correspond to the reference characters as follows:

10. apparatus
12. reactor
14. surge tank

16. Krystal crystallizer
18. filtering means
20. return pump
22. return conduit
24. KOH feed
26. $NH_3$ feed
28. $H_2O$ feed
30. $HNO_3$ feed
32. $H_2NCH_2CH_2NH_2$ feed
34. heating jacket (for 14)
35. cooling jacket (for 12)
36. heating water inlet (for 14)
37. cooling water inlet (for 12)
38. heating water outlet (for 14)
39. cooling water outlet (for 12)
40. outlet (of 12)
42. outlet (of 14)
44. inlet (of 16)
46. tank (of 16)
48. conduit (of 16)
50. pump
52. heat exchanger
54. inlet (of 52)
56. outlet (of 52)
58. conduit (of 16)
60. deflector (of 16)
62. outlet (of 16)
64. material (in tank 16)
66. vessel (of 16)
68. filter belt (of 18)
70. roller (of 18)
72 roller (of 18)
74. damp EAK

DETAILED DESCRIPTION OF THE PREFERRED EMBODIMENTS

The apparatus shown in the drawing figure generally comprises a reactor 12, a heated surge tank 14, a Krystal crystallizer generally indicated at 16, filtering means generally indicated at 18, a return pump 20 and conduit 22, and feedstocks 24, 26, 28, 30, and 32, respectively of potassium hydroxide, liquid ammonia, water, nitric acid, and ethylene diamine. Reactor 12 is conveniently a stainless steel vessel having a capacity of roughly 500 gallons. Surge tank 14 is similarly sized and configured. Reactor 12 and tank 14 have water jackets 34 and 35 including water inlets 36 and 37 and outlets 38 and 39. Reactor 12 is cooled to remove the heat of reaction, while tank 14 is heated to keep the components of EAK in solution. Tank 14 collects the effluent from outlet 40 of reactor 12. Outlet 42 of tank 14 is connected to inlet 44 of crystallizer 16.

Crystallizer 16 is substantially as described in *Perry's Chemical Engineer's Handbook*, (fourth edition, 1963), pages 17–20 and 17–21, except that it has been modified for continuous operation. A mixture of the fresh solution from outlet 42 and recycled solution from the upper extremity of tank 46 is drawn into conduit 48 by pump 50, then passes through heat exchanger 52. Heat exchanger 52 has an inlet 54 and outlet 56 to accommodate the flow of cooling water. Conduit 58 carries the effluent from heat exchanger 52 to a point near the bottom of tank 46. Deflector 60 prevents the effluent of conduit 58 from passing directly to the lower outlet 62 of tank 46.

The material 64 in tank 46 is a mixture of growing crystals and supersaturated solution in countercurrent flow. The supersaturated solution flows upward and becomes less saturated due to crystal growth. The solution is least supersaturated near the top of tank 46 where it is drawn into conduit 48. The crystals are classified according to their size by the upward flow of supersaturated solution, and when they become large enough they drop to outlet 62 and out of the crystallizer. Vessel 66 collects very small crystals to increase the average crystal size within tank 46 and to prevent nucleation within heat exchanger 52.

Mother liquor and crystals flowing from outlet 62 are intercepted by filtering means 18. Filtering means 18 is here shown as an endless filter belt 68 carried on rollers 70 and 72, the former being an idler and the latter being driven. Crystalline EAK is supported by belt 68, and mother liquor passes through belt 68 and is recycled by pump 20 and conduit 22 to reactor 12. Feedstocks 24, 26, 28, 30 and 32 are blended with the mother liquor to replenish it, thereby reforming the original composition in tank 12. The damp EAK 74 carried by filter belt 68 falls off the end of the belt and is preferably transported directly to a series of small melt kettles to be heated and cast. Heating to 100° C. or more drives off any entrained water from the EAK mixture crystals.

Specific operating conditions for practicing the present invention are set forth in several examples below.

It will be appreciated that the feedstocks for reactor 12 could also be ammonium nitrate, potassium nitrate, and ethylene diamine dinitrate. However, the ingredients described previously are preferred, as ethylene diamine dinitrate is shock and temperature sensitive and thus should neither be stored in large quantities nor concentrated substantially.

The reactions by which potassium hydroxide, ammonia, water, nitric acid, and ethylene diamine are converted to the components of EAK are set forth immediately below:

$$HNO_3(aq)+NH_3 \rightarrow NH_4NO_3(aq)$$

$$2HNO_3(aq)+H_2NCH_2CH_2NH_2 \rightarrow O_2NHCH_2CH_2NHNO_2(aq)$$

$$HNO_3(aq)+KOH(aq) \rightarrow KNO_3(aq)+H_2O$$

There are no by-products of the reactions except water and heat of reaction. The result of these reactions is the same as though the components of EAK were directly added, but none of the present reactants are particularly shock or temperature sensitive. Furthermore, because the components of EAK are formed in situ, the ambient water thoroughly wets each ingredient and ionizes the nitrates, thereby greatly reducing the hazard of an explosion or fire. An alcohol or other organic medium will not have as great a desensitizing effect and may be flammable as well. Also, the present water medium will evaporate rapidly if its temperature approaches 100° Celsius, so the heat of an exotherm would rapidly be dissipated as latent heat of vaporization. Finally, the preferred reaction conditions set forth in the examples below are such that the temperature of the process never exceeds 80° C., well below the temperature at which concentrated EAK is liable to explode, provided that the heats of reaction (especially of ethylene diamine and nitric acid) are properly controlled by the cooling water of reactor 12.

As indicated previously, EAK is a eutectic mixture having well defined proportions of 46% ammonium nitrate, 46% ethylene diamine dinitrate, and 8% potassium nitrate. It will be appreciated, however, that the present discovery does not relate to the composition of EAK but to a process for producing it. Consequently, variations of the proportions of EAK are contemplated within the scope of the invention. The composition is controlled by initial concentrations of the three ingredients fed to the crystallizer, and the initial and final temperatures of the crystallizer.

The following examples are provided to show operable process conditions within the scope of the invention. The examples do not define or limit the scope of the invention, but merely illustrate its practice.

EXAMPLE ONE

In this example the fluid in surge tank 14 comprises 100 parts by weight water, 101 parts by weight ammonium nitrate, 68 parts by weight ethylene diamine dinitrate, and 22 parts potassium nitrate. Expressed as percentages, the fluid contains about 34% by weight water, about 35% by weight ammonium nitrate, about 23% by weight ethylene diamine dinitrate, and about 8% by weight potassium nitrate. This mixture is charged to crystallizer 16 via conduit 48. The temperature of the solution delivered to conduit 48 is about 50° C. in this example.

Heat exchanger 52 reduces the temperature of the solution from 50° C. to 30° C., thereby reducing the solubility of each component so that the solution is supersaturated with respect to each component of EAK. As a result, crystals having the proportions of the eutectic composition form. For each cycle of the mother liquor through reactor 12, surge tank 14, crystallizer 16, filter 18, pump 20, and conduit 22, 28 parts by weight of ammonium nitrate, 28 parts by weight of ethylene diamine dinitrate, and 5.7 parts by weight of potassium nitrate concurrently crystallize. As a result, 60.3 parts of EAK are formed and discharged in each cycle. The mother liquor flowing through conduit 22 has a composition of 73.3 parts by weight ammonium nitrate, 40 parts by weight ethylene diamine dinitrate, 17.3 parts by weight potassium nitrate, and 100 parts by weight water.

For each cycle, stoichiometric proportions of potassium hydroxide, ammonia, nitric acid, and ethylene diamine are charged to reactor 12 for each cycle to replace 60.3 parts by weight of EAK. Enough water is charged to reactor 12 to replace entrained liquid lost with the crystalline product and as a result of other losses, minus the water produced by the reactions referred to previously.

One or more of the feedstocks can optionally be combined before being added to reactor 12. For example, the water and nitric acid feedstocks are conveniently combined, as nitric acid is conventionally provided as a concentrated water solution.

EXAMPLES 2-5

The procedure of Example 1 is followed, except the initial and final temperatures and the concentrations of ingredients found in the mother liquor and delivered to the crystallizer are varied as set forth in Table I. The corresponding values for Example 1 also appear in Table I for comparison.

TABLE I

Part 1: Conditions at inlet of conduit 48

| Example | Temp. °C. | $H_2O$ | AN[1] | EDD[2] | KN[3] |
|---|---|---|---|---|---|
| | | Parts by Weight | | | |
| 1 | 50 | 100.0 | 101.0 | 68.0 | 22.0 |
| 2 | 50 | 100.0 | 104.0 | 72.3 | 19.7 |
| 3 | 40 | 100.0 | 90.2 | 58.5 | 17.2 |
| 4 | 60 | 100.0 | 115.0 | 81.7 | 24.8 |
| 5 | 80 | 100.00 | 142.3 | 109.0 | 29.3 |

Part 2: Conditions at Inlet of Conduit 22 (mother liquor)

| Example | Temp., °C. | $H_2O$ | AN | EDD | KN |
|---|---|---|---|---|---|
| | | Parts by Weight | | | |
| 1 | 30 | 100.0 | 73.3 | 40.0 | 17.3 |
| 2 | 20 | 100.0 | 62.0 | 30.3 | 12.3 |
| 3 | 20 | 100.0 | 62.0 | 30.3 | 12.3 |
| 4 | 30 | 100.0 | 73.3 | 40.0 | 17.3 |
| 5 | 30 | 100.0 | 73.3 | 40.0 | 17.3 |

Part 3: Parts by Weight of EAK Produced Per Cycle

| Example | Parts By Weight EAK |
|---|---|
| 1 | 60.3 |
| 2 | 91.3 |
| 3 | 61.2 |
| 4 | 90.8 |
| 5 | 150.0 |

[1]AN is ammonium nitrate
[2]EDD is ethylene diamine dinitrate
[3]KN is potassium nitrate

I claim:

1. A process for forming an explosive composition comprising ammonium nitrate, ethylene diamine dinitrate, and potassium nitrate, comprising the steps of:

A. forming an aqueous solution of ammonium nitrate, ethylene diamine dinitrate, and potassium nitrate;

B. cooling said solution sufficiently to concurrently crystallize said ammonium nitrate, ethylene diamine dinitrate, and potassium nitrate, thereby forming a crystallized composition; and C. separating said crystallized composition from the remainder of said aqueous solution.

2. The process of claim 1, wherein step A is performed by replenishing said aqueous solution of step C, thereby providing a cyclical process which produces substantially no waste products.

3. The process of claim 2, wherein the aqueous solution of step C is replenished for each cycle by adding stoichiometric proportions of potassium hydroxide, ammonia, water, nitric acid, and ethylene diamine in adequate amounts to replace the material removed by crystallization during the previous cycle.

4. The process of claim 3, wherein said potassium hydroxide, ammonia, water, nitric acid, ethylene diamine and aqueous solution of step C are continuously fed into a reactor, thereby providing a continuous process.

5. The process of claim 1, wherein the aqueous solution of step A comprises about 34% by weight water, about 35% by weight ammonium nitrate, about 23% by weight ethylene diamine dinitrate, and about 8% by weight potassium nitrate, said solution of step A is maintained at about 50° C., and is cooled in step B to about 30° C., thereby forming a supersaturated solution.

6. The process of claim 1, wherein the aqueous solution of step A is formed by mixing stoichiometric proportions of potassium hydroxide, ammonia, water, nitric acid, and ethylene diamine.

7. The process of claim 6 wherein said potassium hydroxide, ammonia, water nitric acid, and ethylene diamine are continuously fed into a reactor, thereby providing a continuous process.

8. The process of claim 1, wherein the aqueous solution of step A comprises about 100 parts by weight water, about 100 parts by weight ammonium nitrate, about 72 parts by weight etylene diamine dinitrate, and about 20 parts by weight potassium nitrate, said solution of step A is maintained at about 50° C., and is cooled in step B to about 20° C., thereby forming a supersaturated solution.

9. The process of claim 1, wherein the aqueous solution of step A comprises about 100 parts by weight water, about 90 parts by weight ammonium nitrate, about 59 parts by weight ethylene diamine dinitrate, and about 17 parts by weight potassium nitrate, said solution of step A is maintained at about 40° C., and is cooled in step B to about 20° C. thereby forming a supersaturated solution.

10. The process of claim 1, wherein the aqueous solution of step A comprises about 100 parts by weight water, about 115 parts by weight ammonium nitrate, about 82 parts by weight ethylene diamine dinitrate, and about 25 parts by weight potassium nitrate, said solution of step A is maintained at about 60° C., and is cooled in step B to about 30° C., thereby forming a supersaturated solution.

11. The process of claim 1, wherein the aqueous solution of step A comprises about 100 parts by weight water, about 142 parts by weight ammonium nitrate, about 109 parts by weight ethylene diamine dinitrate, and about 29 parts by weight potassium nitrate, said solution of step A is maintained at about 80° C., and is cooled in step B to about 30° C., thereby forming a supersaturated solution.

12. A process for forming an explosive eutectic composition comprising about 46% ammonium nitrate, 46% ethylene diamine dinitrate, and about 8% potassium nitrate, comprising the steps of:

A. Forming an aqueous solution of about 34% by weight water, about 35% by weight ammonium nitrate, about 23% by weight ethylene diamine dinitrate, and about 8% by weight potassium nitrate, maintained at a temperature of about 50° C.;

B. Cooling said solution to about 30° C., thereby supersaturating said solution with respect to each solute thereof;

C. Passing said supersaturated solution in counter-current to a stream of nucleating crystals, thereby growing crystals having eutectic proportions;

D. Separating said crystals from the residual mother liquor;

E. Recycling said mother liquor; and

F. Adding to said mother liquor stoichiometric proportions of potassium hydroxide, ammonia, water, nitric acid, and ethylene diamine in adequate amounts to replace the material removed by crystallization during the previous cycle, thereby reforming the solution in step A above.

* * * * *